United States Patent [19]

Anderson

[11] Patent Number: 4,461,970

[45] Date of Patent: Jul. 24, 1984

[54] SHIELDED HOLLOW CATHODE ELECTRODE FOR FLUORESCENT LAMP

[75] Inventor: John M. Anderson, Scotia, N.Y.

[73] Assignee: General Electric Company, Schenectady, N.Y.

[21] Appl. No.: 324,926

[22] Filed: Nov. 25, 1981

[51] Int. Cl.[3] ..... H01J 1/20; H01J 1/24

[52] U.S. Cl. ..... 313/240; 313/339; 313/356

[58] Field of Search ..... 313/240, 242, 270, 282, 313/339, 356

[56] References Cited

U.S. PATENT DOCUMENTS

| | | | |
|---|---|---|---|
| 2,549,355 | 4/1951 | Winninghoff | 313/240 X |
| 2,847,605 | 8/1958 | Byer | 313/339 X |
| 3,121,184 | 2/1964 | Fox | 313/242 X |
| 3,383,541 | 5/1968 | Ferriera | 313/339 X |
| 3,390,297 | 6/1968 | Vollmer | 313/239 X |
| 3,515,932 | 6/1970 | King | 313/339 |

*Primary Examiner*—Eugene R. Laroche

*Attorney, Agent, or Firm*—William H. Steinberg; James C. Davis, Jr.; Marvin Snyder

[57] ABSTRACT

A hollow cathode electrode, particularly useful in fluorescent lamps, comprises an outer metal sleeve, an inner metal sleeve disposed within the outer sleeve and an emissive mix disposed on the inner sleeve. In one embodiment, the inner sleeve is a folded cylinder having a square cross section disposed within a circular cylinder. The object of the present invention is to prevent heat loss from the inner sleeve and to minimize sputtering. The electrode of the present invention may also include a third exterior sleeve surrounding but not contacting the interior sleeve or sleeves.

12 Claims, 9 Drawing Figures

SHIELDED HOLLOW CATHODE ELECTRODE FOR FLUORESCENT LAMP

BACKGROUND OF THE DISCLOSURE

This invention relates to electrodes, and, more particularly, to hollow cathode electrodes for use in fluorescent lamps.

Conventional fluorescent lamp electrodes contribute to darkening of the ends of the lamp. This phenomenon reduces the luminous efficacy of the lamp as a function of lamp running time. The material deposited on the walls of the lamp is typically a mixture of evaporated barium and other material sputtered from the electrode. Additionally, this phenomenon also limits the life of the lamp because of the eventual removal of emission mix from the electrodes so that starting becomes difficult for the lamp ballast.

Hollow electrodes are generally operable in the so-called hollow cathode discharge mode of operation and such hollow electrodes offer several advantages. First, these electrodes generally produce less darkening of the lamp ends and a longer lamp life with better lumen maintenance over the life of the lamp, than do lamps employing heated filament cathodes. The reason for this advantage is the containment of sputtered and evaporated material within the hollow portion of the electrode. For the case of barium emissive mixes, this is especially useful since it provides a low work function and a correspondingly low electrode fall voltage, which, in turn, reduces sputtering. The work function is a measure of the energy required for removal of electrons from the surface of the electrode.

Simple cylindrical sleeve electrodes having emission mixes disposed on their interior surfaces are known in the prior art. In particular, A. Bouwknegt and A.G. Vanderkooi have reported on such structures in *Proceedings of the First International Conference on Gas Discharges,* 1971, pg. 217. In this paper, the authors indicated that desirable goals would include 50,000 lamp starts with 12,000 hours of average lamp life. However, using only the simple hollow electrode, the above authors indicated that such lamps operate for only 12,000 hours without serious depreciation, the lamp having incured only 6,000 starts. In contrast, conventional presentday fluorescent lamps generally exhibit an average life in excess of approximately 20,000 hours.

Many of the problems associated with poor starting and shortened lamp life are related to the simple cylindrical electrode employed. In particular, it is first noted that the opposite electrode surface from that which holds the emission mix, namely, the outside of the cylinder, is exposed for thermal radiation. Since emission requires a temperature of approximately 800° C. to approximately 900° C., this results in a considerable rate of energy loss. The cathode fall voltage must increase and/or current must increase to supply this energy at the electrode surface. Additionally, the starting of the discharge involves some deterioration of the end of the cylinder. Furthermore, lamp starting tends to destroy emission mix and the high operating temperature can lead to punch-through of the cylinder.

It should also be noted that it is highly desirable that any electrode, particularly fluorescent lamp electrodes, be configured in a structural arrangement which promotes rapid, facile and economical assembly. Accordingly, improvements in the conventional hollow cathode electrode design should not generally preclude rapid and economical manufacture.

SUMMARY OF THE INVENTION

In accordance with a preferred embodiment of the present invention, a hollow cathode electrode, especially for use in fluorescent lamps, comprises an outer metal sleeve, an inner metal sleeve disposed within the outer sleeve and substantially coaxial therewith and an emissive mix disposed on the inner sleeve. In one embodiment of the present invention, the inner sleeve possesses a rectangular cross section and is preferably formed by folding a strip of metal into a parallelepiped shape. In this embodiment, the outer sleeve is preferably a circular cylinder into which the folded inner sleeve is inserted. In accordance with still another embodiment of the present invention, there is included a third cylindrical sleeve supported in either a contacting or noncontacting relationship and surrounding the innermost sleeve. This provides a doubly shielded design.

Accordingly, it is an object of the present invention to provide a long life, low sputtering fluorescent lamp electrode.

It is also an object of the present invention to improve fluorescent lamp efficacy and to reduce lamp end darkening.

It is a still further object of the present invention to minimize radiated heat loss from hollow cathode electrodes.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE PRESENT INVENTION

Figure 1:
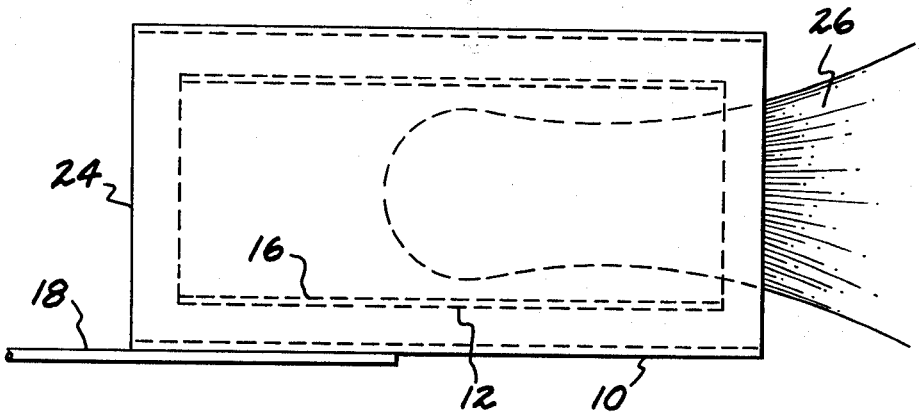
FIG. 1 is a side elevation view of the present invention illustrating its operation in the hollow cathode mode.
Figure 3:
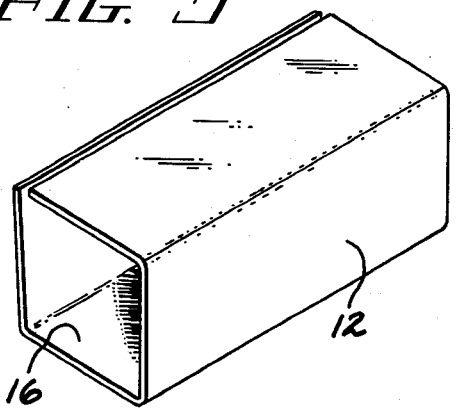
FIG. 3 is an isometric view illustrating the folded metal inner sleeve structure shown in the end view of FIG. 2.
Figure 2:
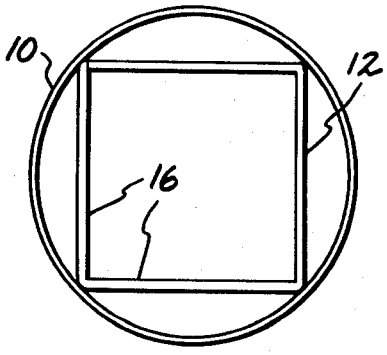
FIG. 2 is an end view of the embodiment illustrated in FIG. 1.

Before a discussion of the operation of the present invention is undertaken, it is desirable to discuss its essential construction features, particularly as illustrated in FIGS. 1–3. In FIG. 1, there is shown an outer cylindrical sleeve 10 having inner sleeve 12 disposed inside it in a substantially coaxial arrangement. Both sleeves are preferably metallic and inner sleeve 12 is preferably coated on the inside thereof with emissive mix 16, more particularly described below. Inner sleeve 12 preferably comprises nickel and is in the form of a folded metal sheet having a thickness of approximately 2 mils. FIG. 1 also more particularly illustrates the presence of plasma discharge 26 which is particularly illustrative of the hollow cathode discharge mode of electrode operation. Furthermore, sleeve 10 may also include end wall 24 which acts to partially close sleeve 10 to further promote its function as a heat shield. Lastly, outer sleeve 10 is supported on electrically-conductive rod 18 and is fastened thereon by spot welding, for example, this being the preferred mode of fastening herein. However, any convenient means of support may be employed. FIG. 2 illustrates an end view of the electrode embodiment shown in FIG. 1 and particularly illustrates the ease of assembly of this electrode structure and the fact that inner sleeve 12 is easily formed from a folded strip of material and is readily insertable into outer sleeve 10 in a fashion which tends to hold sleeve 12 in a fixed position therein by a friction fit.

For purposes of description of the present invention, and for interpretation of the claims herein, it should be particularly noted that the term "cylinder" as employed herein refers to the general mathematical meaning of this term, and is not limited to the special case of right circular cylinders. The cylinders themselves might be right-elliptical cylinders, or the right-square cylinder illustrated in FIG. 3. More particularly, with reference to FIG. 2, it is noted that there is shown a square cylinder disposed within a circular cylinder. However, without departing from the essence of the present invention, it is also possible to dispose a right circular cylinder within a right-square cylinder or even an elliptical cylinder within a square or circular cylinder or vice-versa.

The emitting material 16 may be any conventionally-employed material include lanthanum hexaboride or barium calcium aluminate but more preferably comprises the triple oxide of barium, calcium and strontium, because this mix is inexpensive and provides a low work function. A suitable inner emitting surface is that prepared for radio vacuum tubes where the triple carbonate of barium, calcium and strontium is rolled onto a nickel base, preferably active nickel. It is also possible to add zirconium metal powder or zirconium hydride to the mix. Nickel powder may also be added to improve conductivity through the oxide layer.

Tests employing the electrode structure exhibited in FIGS. 1–3 have been conducted. The electrode comprises a square inner cylinder of thin nickel having rolled emission mix on its interior surface. This inner cylinder was slipped into a second thin nickel sleeve which acted as an outer radiation shield. In particular, while the inner cathode surface operated at a temperature of approximately 800° C., the outer sleeve operated at a temperature of only approximately 500° C. These electrodes have operated for over 500 hours, supporting a discharge in a 2.5 torr mixture of argon and mercury with the mercury being at a pressure corresponding to room temperature. The overall discharge voltage increased by about 0.5 volts from an initial voltage of 10.5 volts. Even though 500 hours appears to be a short time relative to a desired lifetime of at least 20,000 hours, experience indicates that the negligible depreciation of the electrodes predicts a long life for this electrode design. It was also observed that the walls of the discharge envelope were not darkened with deposits as would be the case if conventional "stick" electrodes were operated for this length of time under the same conditions.

With respect to lamp operation, it is to be noted that, when starting, arc current concentrates on the outer cylinder and after this cylinder is heated to a dull red color, arc current moves inside the rectangular cylinder to initiate operation in the diffuse-emitting hollow cathode mode. This process takes approximately 3 seconds. During this time, and after a large number of starts, there is some sputtering away of material from this outermost surface. However, this is not normally the emitting surface and long cathode life is still exhibited. Moreover, during continuous running, there is some diffusion of barium outside of the inner cylinder and onto the outer cylindrical surface. In fact, this is helpful for subsequent lamp starting and, accordingly, is not an undesirable feature.

Figure 4:
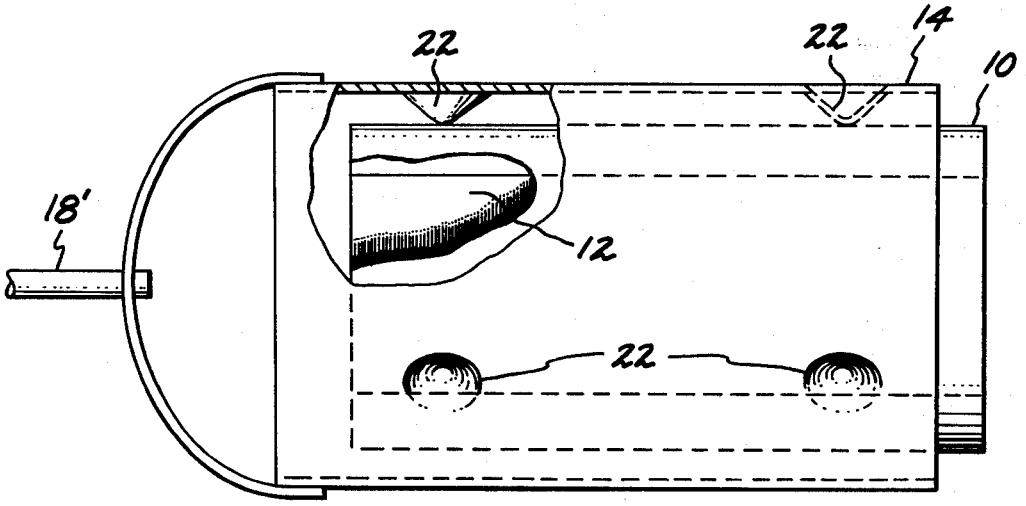
FIG. 4 is a side elevation view of an embodiment of the present invention employing three substantially coaxial cylindrical sleeves.
Figure 5:
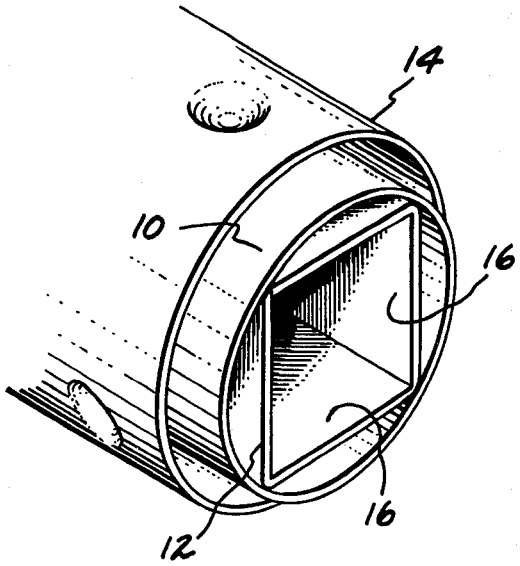
FIG. 5 is an isometric view of an end of the electrode illustrated in FIG. 4.
Figure 6:
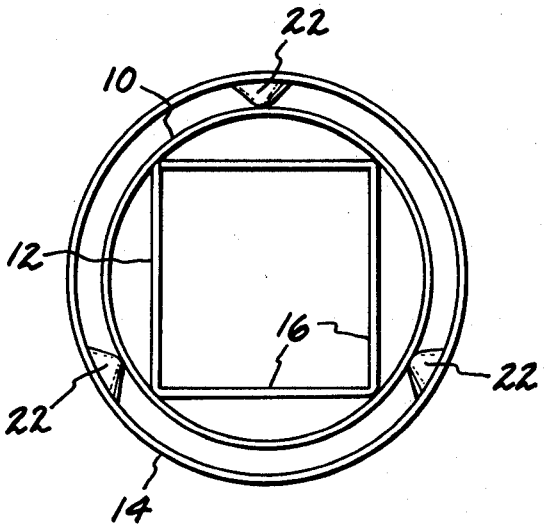
FIG. 6 is an end view of the electrode illustrated in FIGS. 4 and 5.

The above tests were conducted at a discharge current of approximately 1 ampere since lower currents promote increased cathode fall voltage. This is due to heat loss from the electrode. While 1 ampere is required for some fluorescent lamps, a more typical current is approximately 430 milliamperes. Thus, to get this lower current with a low cathode fall voltage, additional energy conservation is desirable. Accordingly, for such fluorescent lamps and lamp applications, the structure illustrated in FIGS. 4–6 is preferred. In FIGS. 4–6, inner sleeve 12 and sleeve 10 are preferably as previously described. Additionally, sleeve 10 is held within third sleeve 14 which acts as an additional radiation shield. In this embodiment, sleeve 10, which was previously described as an outer sleeve, is actually an intermediate sleeve with sleeve 14 being the outermost sleeve. Sleeve 10 is held in a fixed position within outer sleeve 14 by any convenient means. For example, indentations 22 in outer sleeve 14 may be provided to achieve this purpose. In any event, whatever means of support for sleeve 10 is provided, it is desirable that sleeves 10 and 14 exhibit minimal physical contact, so as to reduce thermal conductive losses. In the embodiment shown, sleeves 10 and 12 project slightly from outermost sleeve 14. The entire assembly comprising sleeves 10, 12 and 14, and emissive mix 16 may be supported on conductive rod 18' such as that shown in FIG. 4. FIG. 5 provides an isometric view of the structure shown in FIG. 4 and FIG. 6 provides an end view of the same structure more particularly illustrative of indentations 22 for support of sleeve 10. Additionally, any of the sleeves illustrated in FIGS. 4–6 may also include a rear wall portion for further containment of thermal wavelength radiation. A similar structure 24 is shown in FIG. 1.

Certain features of the structures illustrated in FIGS. 4–6 are worthy of note. In particular, it is to be noted that each sleeve is readily manufacturable and the entire assembly is readily put together simply by sliding the sleeves into one another. Furthermore, it is preferable that the inner structure protrude somewhat from the outer sleeve 14 in order that the inner cylinders be the starting surface and also to collect anode current for additional heating. Inner rectangular sleeve 12 also preferably contacts intermediate sleeve 10 at least at the tip of the intermediate sleeve so that the arc can transfer to the inner emitting surface. However, at other points this contact is minimized to reduce heat conduction. Furthermore, heat conducting along support rod 18' is minimized by using thin wires, preferably comprising nickel, or other weldable metal. Additional shields may also be provided particularly if the increasing cost and complexity is justified by the intended use.

Figure 7:
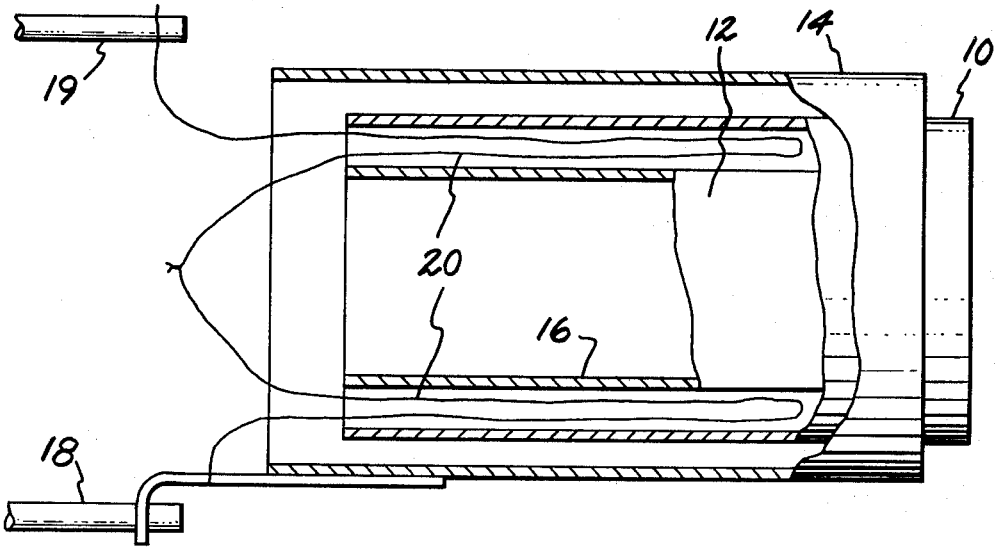
FIG. 7 is a side elevation view illustrating the use of a separate heater coil used in the embodiment illustrated in FIGS. 4–6.

The electrodes illustrated so far in FIGS. 1–6 are primarily applicable to so-called instant start fluorescent lamps where application of auxiliary heating is not possible. However, with only minor modifications, the electrode structure of the present invention may be employed in so-called rapid start fluorescent lamps in which auxiliary heating is heating is employed. If such preheating or auxiliary heating is required, there are at least two ways to provide this function. In a first approach, the emitting surface or intermediate sleeve is made from a long thin ribbon which serves as a conductor to provide ohmic heating of the cathode surface. It is formed into a sleeve and ends attached to the lead-in wires for current continuity. In a second approach, the structure is heated with an indirect heater such as is done with the cathodes of radio tubes. In this case, heating wires are inserted between the two inner cylindrical sleeves and connected to lead-in/support wires 18 and 19 as shown in FIG. 7. The embodiment illustrated in FIG. 7 is similar to that shown in FIGS. 4–6 except that heater wires 20 for cathode heating are shown disposed between the two innermost sleeves. This indirect heating has the advantage that higher voltage (approximately 2–3 volts) and a lower current (less than 1 ampere) can be chosen for the heater.

The entire electrode structure described herein may be automatically assembled and employs inexpensive, already developed emissive mix materials. The activation of these materials during lamp manufacture is most easily done by induction heating. However, if residual gases are sufficiently high enough in pressure to cause breakdown and it is not desired to spend assembly time to remove them by pumping, activation of these materials is accomplished through use of the auxiliary heater illustrated in FIG. 7, or by focussed laser radiation.

For the embodiments illustrated in FIGS. 4–6, it has also been particularly noted that, for low current lamps, there is a certain amount of barium diffusion, either over surfaces or through the discharge gas to the outer and inner surfaces of the outer shield and that the small electron emission from these surfaces can reduce the current in the hollow cathode itself. Current reduction in turn tends to raise the electrode drop which increases current flow to the shield resulting in a pinkish glow due to the excitation of argon, which excitation is made possible by the higher energy electrons accelerated by the cathode fall voltage. Accordingly, for lamps operated at such current levels, it is not desirable to operate the electrodes of the present invention with all electrode surfaces at the same electrical potential even though a partially insulated structure tends to reduce manufacturing ease as well as the number of separate parts employed. However, for such lamps electrical insulation of the inner and outer sleeves is readily accomplished. The embodiments illustrated in FIGS. 8 and 9 more particularly illustrate such an embodiment for which insulation is provided. In particular, in FIG. 8 support 21 is disposed through insulating glass rod 28 so as to hold innermost sleeves 10 and 12 in a non-conducting, substantially coaxial relationship with outer sleeve 11. This structure is shown in more detail in FIG. 9 which particularly illustrates the presence of folded triangular flaps 23. Supporting lead 21 may be disposed through aperture 27 to preserve its insulating function. This structure prevents, or at least renders negligible, any discharge current to the shield and forces essentially all the current into the cathode interior. Shield 11 assumes a sufficiently negative potential to repel electrons in excess of the positive ion current which flows through it. If these insulated and shielded electrodes are found to be detrimental to the starting of a lamp in a particular lamp design, due to increased electrical potentials they may acquire during starting, the shields may be grounded to the cathode proper through a sufficient resistance to impede current flow but yet to control their potential. Sleeves employed in the cathode structure of the present invention may be insulated from one another in any convenient manner. However, it is to be noted that the use of wire suspensions from a glass wire press are particularly useful and this technology has been proven successful in the manufacture of cathode ray electron guns and for dynodes in photomultiplier tubes.

Figure 8:
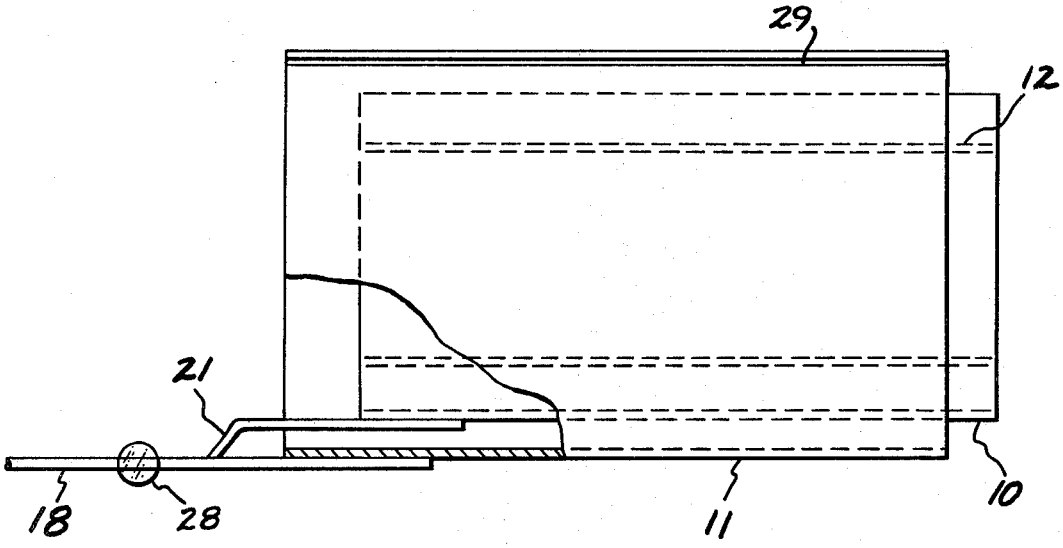
FIG. 8 is a side elevation view of an embodiment of the present invention in which the outer cylinder is supported in a noncontacting relationship with the inner sleeves.
Figure 9:
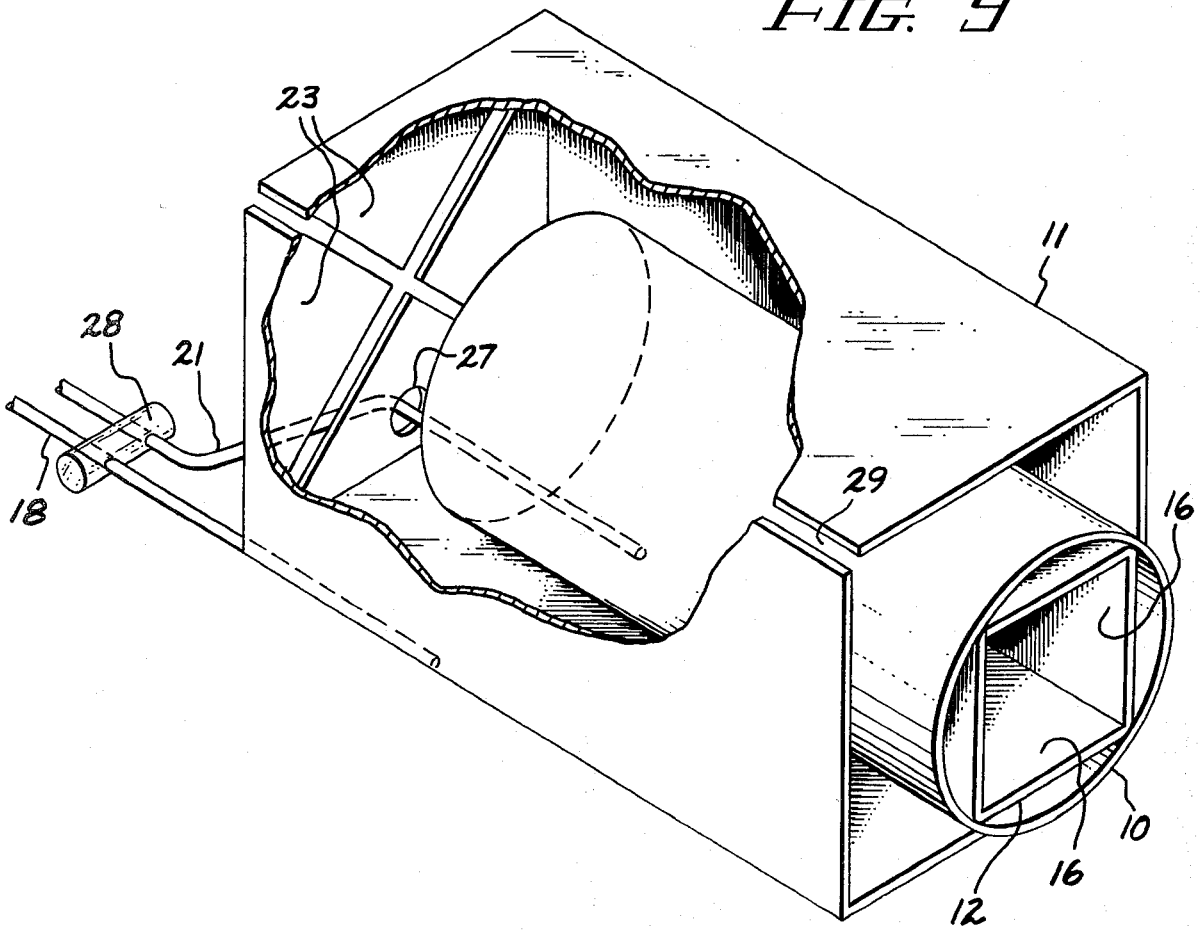
FIG. 9 is an isometric view of the embodiment illustrated in FIG. 8.

It is also to be noted that outer shield 11 in FIGS. 8 and 9 may be provided with slit 29. Slit 29 is provided in the event of activation of emissive material 16 by induction heating. Slit 29 in the outer shield prevents eddy current heating there by interrupting the current path but instead forces induced currents to flow in inner structure 10.

From the above, it may be appreciated that the present invention provides an electrode structure for fluorescent lamps which does, in fact, reduce sputtering, increase lamp efficacy and life, and yet is, nonetheless, easily manufactured and assembled from materials well known in the electrode arts. Moreover, it is seen, particularly with the insulated shield embodiments, that the present invention is employable not only with fluorescent lamps operating at high current levels, but also in lamps operating at low current levels.

While the invention has been described in detail herein, in accord with certain preferred embodiments thereof, many modifications and changes therein may be effected by those skilled in the arts. Accordingly, it is intended by the appended claims to cover all such modifications and changes as fall within the true spirit and scope of the invention.

The invention claimed is:

1. A hollow cathode electrode, especially for use in fluorescent lamps, comprising:

a first outer metal sleeve;

an inner metal sleeve disposed within said first outer sleeve and substantially coaxial therewith said first outer sleeve providing heat shielding and situated in contact with said inner sleeve for aiding in arc initiation; and an emissive mix disposed on said inner sleeve.

2. The electrode of claim 1 in which said inner sleeve has a rectangular cross section.

3. The electrode of claim 2 in which said inner sleeve comprises a strip of metal folded into the shape of a parallelpiped.

4. The electrode of claim 1 in which said first outer sleeve is a circular cylinder.

5. The electrode of claim 1 further including a second outer metal sleeve surrounding said first outer sleeve and substantially coaxial therewith.

6. The electrode of claim 5 in which said first outer sleeve is cylindrical.

7. The electrode of claim 5 in which said first outer sleeve is spaced apart from said second outer sleeve by indentations in said second outer sleeve.

8. The electrode of claim 5 in which said first outer sleeve is supported in noncontacting relationship with said second outer sleeve.

9. The electrode of claim 8 in which said first outer and said inner sleeves slightly project from said second outer sleeve at one end thereof.

10. The electrode of claim 8 in which said inner sleeve is friction fit into said first outer sleeve.

11. The electrode of claim 1 further including heating means disposed between said inner and first outer sleeves.

12. The electrode of claim 1 in which one end of said first outer sleeve is closed.

* * * * *